US006945725B2

(12) United States Patent
Cui

(10) Patent No.: US 6,945,725 B2
(45) Date of Patent: Sep. 20, 2005

(54) MULTI-FUNCTIONED IMAGE PROJECTING PEN

(75) Inventor: Jing En Cui, Sanshui (CN)

(73) Assignee: New San Ban Stationery Limited, Kowloon (HK)

( * ) Notice: Subject to any disclaimer, the term of this patent is extended or adjusted under 35 U.S.C. 154(b) by 0 days.

(21) Appl. No.: 11/103,520

(22) Filed: Apr. 12, 2005

(65) Prior Publication Data

US 2005/0180808 A1 Aug. 18, 2005

Related U.S. Application Data

(63) Continuation-in-part of application No. 10/984,938, filed on Nov. 10, 2004.

(30) Foreign Application Priority Data

Dec. 18, 2003 (CN) ..... 200320119342
Jun. 24, 2004 (CN) ..... 200420070808

(51) Int. Cl.[7] ..... B43K 29/00

(52) U.S. Cl. ..... 401/195; 401/52; 345/183; 362/118

(58) Field of Search ..... 401/52, 195; 235/462.45, 235/472.01; 345/180–183; 362/118, 259

(56) References Cited

U.S. PATENT DOCUMENTS

| | | | | |
|---|---|---|---|---|
| 5,617,304 | A * | 4/1997 | Huang | 362/118 |
| 5,993,026 | A * | 11/1999 | Wu | 362/118 |
| 6,133,907 | A | 10/2000 | Liu | 345/183 |
| 6,655,597 | B1 | 12/2003 | Swartz et al. | 235/462.45 |
| 2002/0162891 | A1 | 11/2002 | Mulla et al. | |

* cited by examiner

*Primary Examiner*—Tuan Nguyen
(74) *Attorney, Agent, or Firm*—Rabin & Berdo, P.C.

(57) ABSTRACT

The present invention discloses a multi-functioned image projecting pen, the front end of the jointing tube is connected dismountable to the rear end of pen shaft; the battery, button and luminotron constituting the circuit are mounted into the front end of jointing tube in this order. The button is mounted on the sidewall of jointing tube; the mounting bobbin is mounted movable to the rear end of jointing tube, the diaphragm is set between lighter and mounting bobbin; a moving sleeve is slip connected onto the mounting bobbin protruding out the jointing tube, the projecting lens is fixed at the top of moving sleeve. The moving sleeve is movable on the mounting bobbin according to the invention, the projected image is emerged or removed along the moving in or moving out of the moving sleeve, this makes the product functions as the pen, projecting and flashlight.

5 Claims, 3 Drawing Sheets

MULTI-FUNCTIONED IMAGE PROJECTING PEN

RELATED APPLICATION

This application is a Continuation-In-Part of U.S. patent application Ser. No. 10/984,938, filed Nov. 10, 2004, and which claimed priority from Chinese Application No. 200320119342.2, filed on Dec. 18, 2003.

TECHNOLOGY FIELD

The present invention relates to a pen, especially relates to a multi-functioned image projecting pen with advertisement effect.

BACKGROUND TECHNOLOGY

It is a usual practice in the current pen with advertisement effect that picture & character and trademark are printed onto the pen case to exert an advertisement effect. The printed picture & character and trademark, however, were not conspicuous owing to the little pen case and thus had little advertisement effect. For this reason, the picture & character diaphragm and light were employed to produce a projecting effect and enhance the advertisement effect and thus arose public attention. According to the practice conditions in operation, however, it does not need picture & character projecting function but others such as flashlight etc in sometimes. The present projecting functioned pens project only the advertisement image, could not be used as the lighting flashlight and the operation flexibility is poor.

DISCLOSURE OF THE INVENTION

The present invention is proposed to supply a multi-functioned image projecting pen to project advertisement picture or remove the projected picture according to needs, and thereby improve the operation flexibility.

The present invention is realized by the following technology:

The present invention supplies a multi-functioned image projecting pen, including pen refill, shaft, jointing tube, mounting bobbin, projecting lens and picture & character diaphragm, the front end of said jointing tube is connected dismountable to the rear end of pen shaft; the battery, button and luminotron constituting the circuit are mounted into the front end of jointing tube in this order, the button is mounted on the sidewall of jointing tube; said mounting bobbin is mounted movable to the rear end of jointing tube, the diaphragm is set between the lighter and mounting bobbin; a moving sleeve is slip connected onto the mounting bobbin protruding out the jointing tube, the projecting lens is fixed at the top of moving sleeve, a inward-protruding retainer ring is mounted on the bottom internal wall of moving sleeve and a outward-protruding clasp ring is mounted on the top external wall of mounting bobbin, said clasp ring may be clamped onto the retainer ring. The moving sleeve is movable on the mounting bobbin according to the invention, when the moving sleeve does not be moved out, the button is pressed down, said luminotron emits light, the picture and character on the picture & character diaphragm are projected out through the projecting lens and exert an advertisement influence on public. In time of moving out, the clasping side and retaining side are clamped each other to avoid the moving sleeve separating from the mounting bobbin, in this condition, the distance between projecting lens and luminotron on it is increased, the image projecting focal length is changed, the projected image is removed and could be functioned as others such as flashlight etc.

There is also a rubbing ring being slip connected onto the edge of clasp ring on top of the mounting bobbin according to the invention, the external edge of the rubbing ring is contact against the internal wall of moving sleeve, this could increase the friction force between moving sleeve and mounting bobbin to avoid the moving sleeve slipping back to original position after being moved out.

In order to better positioning the picture & character diaphragm to avoid its turning in course of assemblage, there are also a pressing sleeve and clamping sleeve between lighter and mounting bobbin for picture & character diaphragm assemblage according to the invention, the pressing sleeve top has a recess surface, the pressing sleeve external wall has a rim, there is a recess adapted corresponding to the pressing sleeve top rim on the clamping sleeve internal wall; the diaphragm is on the recess surface of pressing sleeve, the pressing sleeve is wedged within the clamping sleeve, the pressing sleeve is slip connected onto the front port of mounting bobbin and the clamping sleeve is slip connected onto the front of mounting bobbin. The pressing sleeve rim could be seen as a reference positioning location in time of mounting the picture & character diaphragm to mount correctly the diaphragm. In meantime the corresponding wedging of pressing sleeve rim and clamping sleeve recess could avoid the relative turning of each part after slip connecting, and the picture & character diaphragm mounted pressing sleeve and clamping sleeve and mounting bobbin are assembled as a entirety after being corresponding slip connected, in this way, the picture & character diaphragm could not turn relatively in assemblage and the correctness of its angle and position is thus ensured.

The dismountable connection of said jointing tube front end and pen shaft rear end is a kind of screw connection according to the present invention.

In order to increase the projecting brightness and enhance the advertisement effect, the luminotron is covered with a light case according to the present invention, there is also a collector lens between said clamping sleeve and light case.

The present invention has the following beneficial effects of:

(1) Projecting or removing the projected image according to needs, making the product functions as the pen, projecting and flashlight and improving the operation flexibility.

(2) Positioning the picture & character diaphragm even better in operation and exchange, ensuring the diaphragm couldn't turn relatively in assemblage and producing a projected image of correct angle and position, so the operation is flexible, assemblage is convenient, projecting and advertisement effects are even better.

DESCRIPTION OF THE FIGURES

The following embodiments and Figures are cited to give a further detailed description of the present invention.

FIG. 4-1 is a top view of the FIG. 4;

FIG. 5-1 is a top view of the FIG. 5;

CONCRETE EMBODIMENTS OF THE INVENTION

Figure 1:
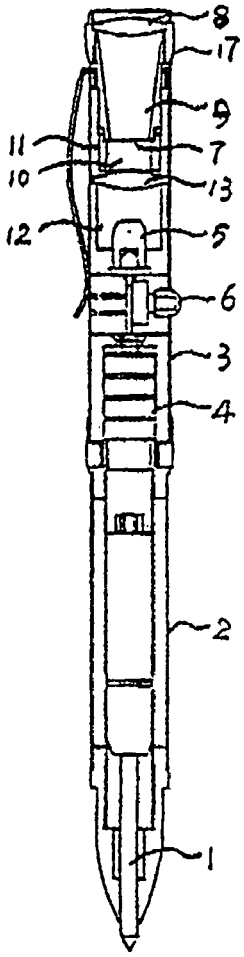
FIG. 1 is a construction illustrative view under the projecting image condition according to the present invention embodiments.
Figure 8:
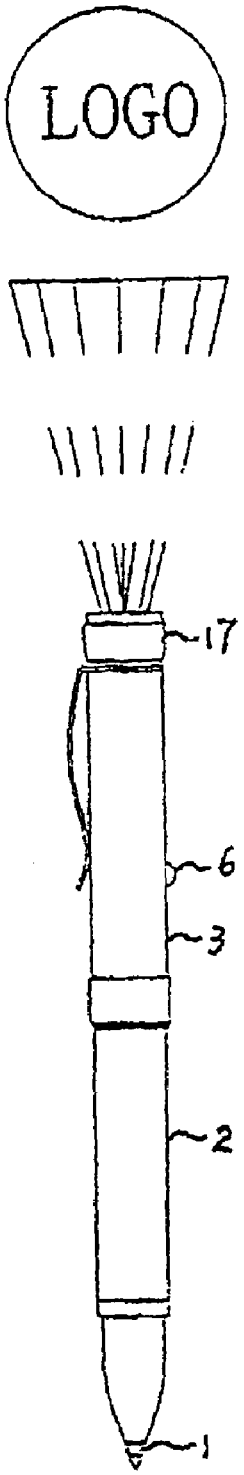
FIG. 8 is an illustrative view showing the projecting image operation state according to the present invention embodiments.
Figure 9:
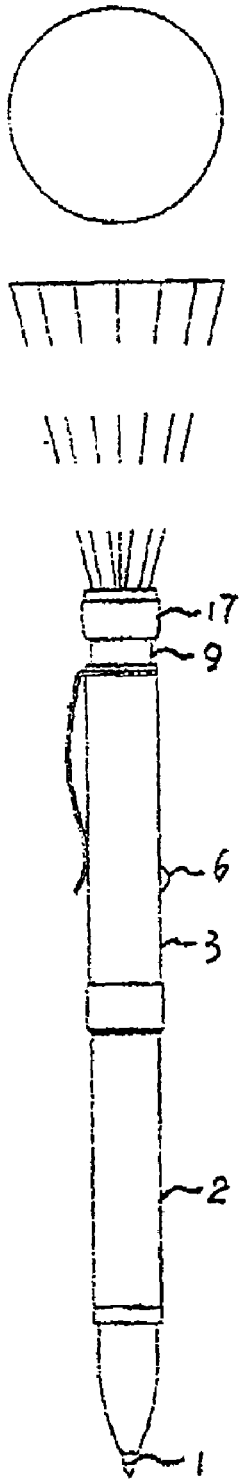
FIG. 9 is an illustrative view showing the removing projected image operation state according to the present invention embodiments.

FIG. 1~FIG. 9 shows the embodiments according to the present Invention, including pen refill 1, shaft 2, jointing tube 3, battery 4, luminotron 5, button 6, picture & character diaphragm 7, projecting lens 8, mounting bobbin 9, pressing sleeve 10, clamping sleeve 11, light case 12, collector lens 13 and moving sleeve 17, among which the luminotron 5 is a LED, the picture & character diaphragm 7 is a diaphragm printed with "LOGO" (refer to FIG. 8). Refer to FIG. 1, the pen refill 1 is within the shaft 2, the front end of jointing tube 3 and the rear end of shaft 2 is screw connected, Refer to FIG. 1 or FIG. 2 and FIG. 3, the battery 4, button 6 and luminotron 5 constituting the circuit is assembled within the front end of jointing tube 3 in this order, the button 6 is located on the sidewall of jointing tube 3, the luminotron 5 is covered with the light case 12. The collector lens 13 is on the top of light case 12.

Figure 4:
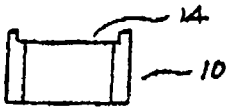
FIG. 4 is a front illustrative view showing the pressing sleeve according to the present invention embodiments.
Figures 1, 4:
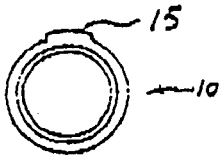
Figure 5:
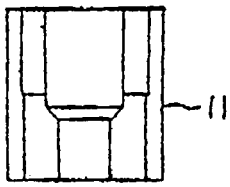
FIG. 5 is a front illustrative view showing the clamping sleeve according to the present invention embodiments.
Figures 1, 5:
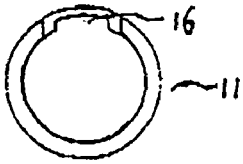
Figure 6:
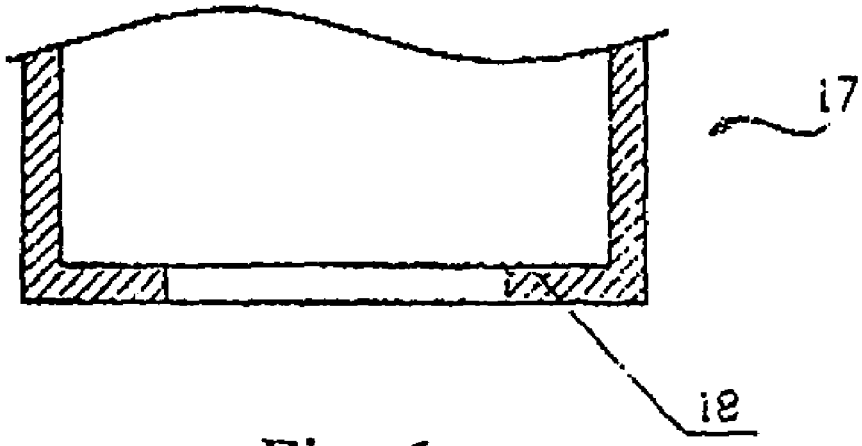
FIG. 6 is a detail view showing the A part of FIG. 3.
Figure 7:
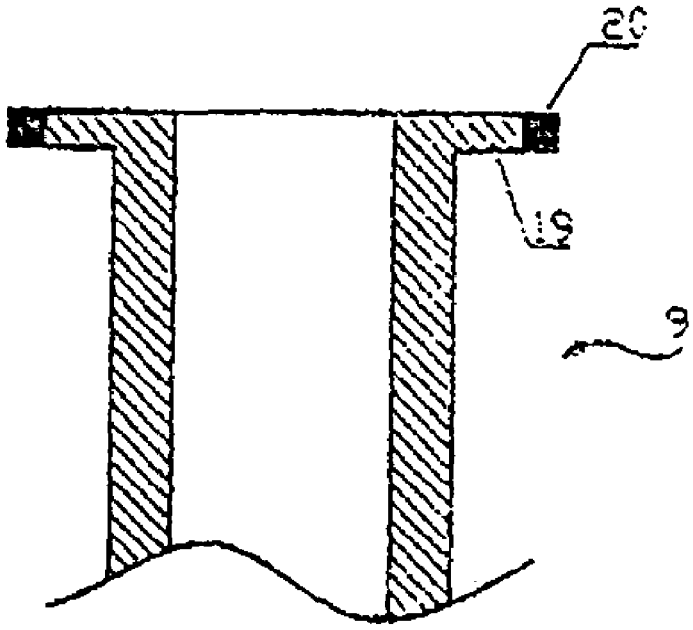
FIG. 7 is a detail view showing the B part of FIG. 3.

Refer to FIG. 4 and FIG. 4-1, there is a recess surface 14 on top of pressing sleeve 10 and there is a rim 15 on its external wall. Refer to FIG. 5 and FIG. 5-1, there is a recess 16 adapted corresponding to the pressing sleeve rim 15 on the internal wall of clamping sleeve 11. With the rim 15 of pressing sleeve 10 as the reference positioning location, the picture & character diaphragm 7 is mounted on the recess 14 of pressing sleeve, and is pressed by the front end of mounting bobbin 9, aligning the pressing sleeve rim 15 with the recess 16 of clamping sleeve, the mounting bobbin 9 and pressing sleeve 10 are slip connected within the clamping sleeve 11 and form a entirety with it. The entirety is assembled onto the rear end of jointing tube 3, the collector lens 13 is clamped between the light case 12 and clamping sleeve 11. The mounting bobbin 9 may be screw connected, and may also be clamped onto the rear end of jointing tube 3.

Figure 2:
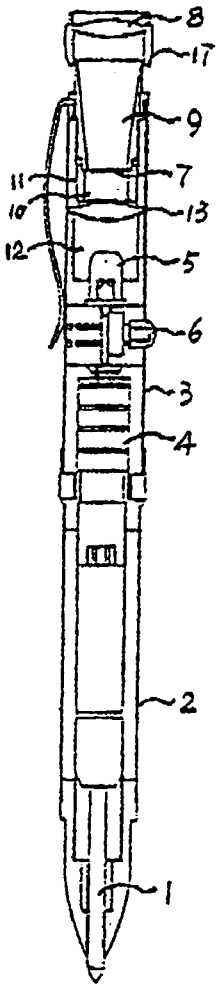
FIG. 2 is a construction illustrative view under the removing projected image condition according to the present invention embodiments.
Figure 3:
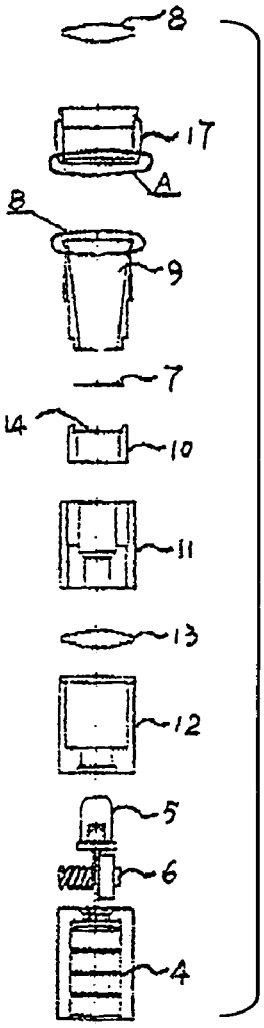
FIG. 3 is an assemblage illustrative view showing the projected part according to the present invention embodiments.

Refer to FIG. 1 and FIG. 2, the moving sleeve 17 is also slip mounted on the mounting bobbin 9 extending out the jointing tube 3, the projecting lens 8 is fixed onto the top of moving sleeve 17, only the inward-protruding retainer ring 18 is mounted on the bottom internal wall of moving sleeve 17 (refer to FIG. 6), a outward-protruding clasp ring 19 is mounted on the top external wall of mounting bobbin 9 (refer to FIG. 7), the clasp ring 19 may be clamped onto the retainer ring 18, there is also a rubbing ring 20 being slip connected onto the edge of clasp ring 19, the external edge of the rubbing ring 20 is contact against the internal wall of moving sleeve 17. In assemblage, the mounting bobbin 9 is first inserted into the moving sleeve 17 from above of the moving sleeve 17, and then assembled as a entirety with the pressing sleeve 10 and clamping sleeve 11, and is connected onto the rear end of jointing tube 3.

Moreover, the moving sleeve 17 and mounting bobbin 9 may be connected by screw to facilitate the moving sleeve 17 screwing out and screwing in on the mounting bobbin 9 (no showing in the figure).

When the moving sleeve 17 does not be moved out (shown as FIG. 1), the button 6 is pressed down, the luminotron 5 emits light, the "LOGO" character on the "LOGO" diaphragm 7 is projected out through the projecting lens 8 via the collector lens 13, and the image shown as FIG. 8 is obtained. In time of moving sleeve 17 moving out (shown as FIG. 2), the clasp ring 19 and retainer ring 18 are clamped each other to avoid the moving sleeve separating from the mounting bobbin, in this condition, the distance between projecting lens 8 and luminotron 5 on it is increased, the image projecting focal length is changed, the projected image is removed (refer to FIG. 9) and could be functioned as others such as flashlight etc, making the product functions as the pen, projecting and flashlight. Each part may be disassembled to facilitate exchange. The images of different picture & character may be obtained by changing different diaphragm 7. The picture & character diaphragm 7 could not turn relatively in assemblage and this ensures its correct angle and position.

I claim:

1. A multi-functioned image projecting pen, including a pen refill, a shaft, a jointing tube, a mounting bobbin, projection lens and a picture & character diaphragm, the front end of said jointing tube is connected dismountable to the rear end of pen shaft; a battery, a button and a luminotron constituting the circuit are mounted into the front end of jointing tube in this order, the button is mounted on the sidewall of jointing tube; said mounting bobbin is mounted movable to the rear end of jointing tube, the diaphragm is set between luminotron and said mounting bobbin, characterized in that: a moving sleeve is also slip connected onto the mounting bobbin protruding out the jointing tube, the projecting lens is fixed at the top of moving sleeve, a inward-protruding retainer ring is mounted on the bottom internal wall of moving sleeve and a outward-protruding clasp ring is mounted on the top external wall of mounting bobbin, said clasp ring adapted to be clamped onto the retainer ring.

2. The multi-functioned image projecting pen according to claim 1, characterized in that: there is also a rubbing ring being slip connected onto the clasp edge of top of the mounting bobbin, the external edge of the rubbing ring is contact against the internal wall of moving sleeve.

3. The multi-functioned image projecting pen according to claim 1, characterized in that: there are also a pressing sleeve and a clamping sleeve between said luminotron and said mounting bobbin for said picture & character diaphragm assemblage, the pressing sleeve top has a recess surface, the pressing sleeve external wall has a rim, there is a recess adapted corresponding to the pressing sleeve top rim on the clamping sleeve internal wall; the diaphragm is on the recess surface of pressing sleeve, the pressing sleeve is wedged within the clamping sleeve, the pressing sleeve is slip connected onto the front port of mounting bobbin and the clamping sleeve is slip connected onto the front of mounting bobbin.

4. The multi-functioned image projecting pen according to claim 1, characterized in that: the dismountable connection of said jointing tube front end and pen shaft rear end is a screw type connection.

5. The multi-functioned image projecting pen according to claim 1, characterized in that: said luminotron is covered with a light case, and there is also a collector lens between said clamping sleeve and light case.

* * * * *